United States Patent [19]

Ettinger et al.

[11] Patent Number: 4,479,104

[45] Date of Patent: Oct. 23, 1984

[54] TRANSFORMER CORE HAVING CHARGE DISSIPATION FACILITY

[75] Inventors: Robert H. Ettinger, Schenectady, N.Y.; Walter J. Pasko, Lee, Mass.

[73] Assignee: General Electric Company, Pittsfield, Mass.

[21] Appl. No.: 337,234

[22] Filed: Jan. 6, 1982

Related U.S. Application Data

[62] Division of Ser. No. 131,652, Mar. 19, 1980, Pat. No. 4,327,349.

[51] Int. Cl.[3] ..... H01F 27/24

[52] U.S. Cl. ..... 336/219; 336/234

[58] Field of Search ..... 336/217, 219, 236, 84 R, 336/84 C; 310/196; 174/127; 29/605, 609

[56] References Cited

U.S. PATENT DOCUMENTS

| | | | |
|---|---|---|---|
| 1,418,856 | 6/1922 | Williamson | 310/196 |
| 1,891,716 | 12/1932 | Laffoon | 310/196 |
| 2,042,208 | 5/1936 | Calvert | 310/196 |
| 2,061,502 | 11/1936 | Calvert | 310/196 |
| 3,824,683 | 7/1974 | Rhudy | 310/196 X |
| 4,008,409 | 2/1977 | Rhudy et al. | 174/127 X |
| 4,095,627 | 6/1978 | Lonseth et al. | 310/196 X |
| 4,207,482 | 6/1980 | Neumeyer et al. | 310/196 X |

*Primary Examiner*—Thomas J. Kozma

*Attorney, Agent, or Firm*—Robert A. Cahill; William Freedman

[57] ABSTRACT

Transformer cores are made electrically conductive during impulse voltage condition when a certain voltage is attained by a coating of semiconductor material applied to the edges or surface of the core laminations. Under ordinary operating conditions the semiconductor material provides a high resistance path to charges in the core. Upon the occurrence of a high voltage impulse, the semiconductor material rapidly equalizes the charges in the laminations and so avoids the danger of breakdown of the insulating coatings between individual laminations.

5 Claims, 5 Drawing Figures

TRANSFORMER CORE HAVING CHARGE DISSIPATION FACILITY

This is a division of application Ser. No. 131,652, filed Mar. 19, 1980, now U.S. Pat. No. 4,327,349.

BACKGROUND OF THE INVENTION

Transformer cores consisting of a plurality of steel laminations are coated on both sides with a first layer of inorganic insulation coating followed sometimes by a layer of an insulating enamel to prevent eddy current transport between the laminations during transformer operation and substantially reduce core eddy loss that would otherwise result.

The presence of the resistive coating between the laminations is such that when a plurality of laminations are stacked together, the stacked core can act as a capacitor bank. In ordinary transformer operation at 60 cycle power frequency, there is little or no current transport occurring between the individual laminations due to the presence of the insulating coatings employed. Upon the occurrence of a high voltage surge condition, however, the transformer core laminations charge in a manner similar to the charging of a series connected capacitor bank. In order to prevent large charges from remaining on the transformer core during normal and surge conditions, a ground lead is interposed between two of the laminations to provide an electrical path to ground. The insulating coatings, however, prevent the ready transfer of the charge current out through the laminations to the ground lead connections. This has the effect of increasing the lamination-to-lamination voltage to above the breakdown strength of insulation.

The purpose of this invention is to provide methods and materials for coating the transformer core laminations and edges with a substance that has good resistance properties under normal operating conditions and readily conducts charge currents to adjacent laminations upon the occurrence of an impulse voltage. Excessive interlaminar potential differences and danger of breakdowns are therefore avoided.

SUMMARY OF THE INVENTION

The invention comprises a coating consisting of a mixture of a semiconducting powder material and an adhesive substance to produce a semiconducting coating. The invention further comprises the application of the coating containing the semiconductive particles to the normally uninsulated edges as well as the surfaces of the transformer core laminations.

DESCRIPTION OF THE PREFERRED EMBODIMENT

Figure 1:
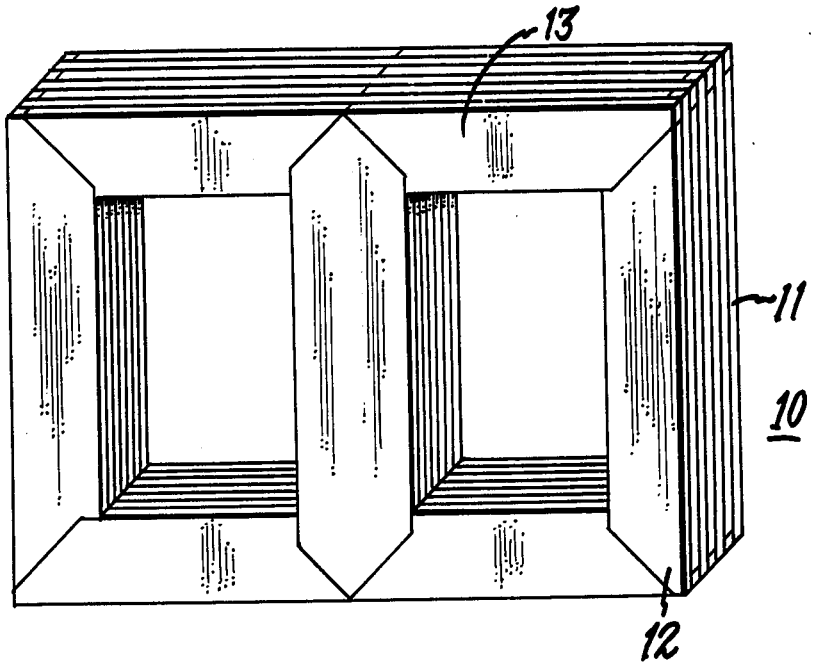
FIG. 1 is a front perspective view of a transformer core for use with the method and materials according to the invention.

A transformer core 10 of the type described in U.S. Pat. No. 3,214,718, for example, is shown in FIG. 1 and consists of a plurality of steel laminations 11 arranged in a plurality of core legs 12 and core yokes 3. In order to prevent electrical continuity between adjoining laminations 11 an inorganic insulating coating 15 is applied to the thin steel plate 14 shown in FIG. 2 which comprises the laminations 11 shown within the core of FIG. 1. The inorganic insulating coatings are generally provided by the steel manufacturer immediately after drawing and processing core steel plate 14. A suitable insulating coating is described within U.S. Pat. No. 3,705,826 which is incorporated herein for purposes of references.

Figure 3:
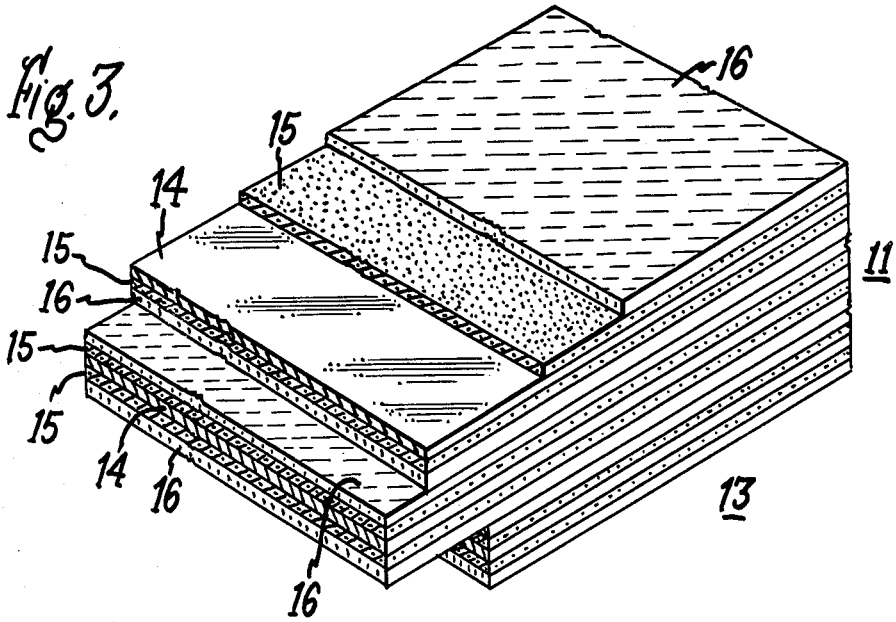
FIG. 3 is a top perspective view, in partial section, of a plurality of the laminations shown in FIG. 1 containing the coating of the instant invention.

FIG. 3 shows a portion of yoke 13 containing a plurality of laminations 11 each consisting of core steel plate 14 with an inorganic insulating coating 15 and further including an insulating enamel coating 16 on both sides. The insulating enamel coating 16 is prepared from a mixture of phenolic resin with linseed oil and diluted with kerosene and naphtha. The phenolic resin adheres to the inorganic insulating coating 15 by the partial oxidation of the linseed oil which occurs during the curing process.

Insulating enamel 16 is generally applied at the transformer manufacturing facility after the individual laminations 11 have been cut to their desired length and shape. Insulating enamel coating 16 insures that any burrs remaining after the core steel cutting process do not penetrate through the inorganic insulating coating 15 on adjoining laminations 11. Semiconductor particles can be added to the insulating enamel 16 used as a coating over the inorganic insulating coating 15 on steel plate 14. The semiconductor particles can comprise a finely powdered silicon carbide prepared by the method described in U.S. Pat. Nos. 1,322,573 and 1,822,742. The fine silicon carbide powder is added within a range by weight to the insulating enamel coating depending upon the degree of conductivity required at impulse voltage ratings. The concentration and nature of the silicon carbide powder in the insulating enamel coating will determine the voltage level attained before bleeding current to other laminations to avoid excessive potential differences between adjacent laminations.

Zinc oxide varistor powder such as that described within U.S. Pat. Nos. 3,642,664, 3,663,458, 3,687,871 and 4,042,532 can also be employed as the semiconductor material used within the insulating enamel coating according to the invention. The use of finely divided zinc oxide varistor powder requires a higher voltage to become conductive than the aforementioned silicon carbide powder. For some applications, the zinc oxide powder is preferred. The amount of zinc oxide powder added to the insulating enamel may be in the range of at least one to ten percent by weight. Coatings having greater than ten percent of the powder can be employed but a range of at least one to ten percent is preferred. When finely ground powder in the size range of less than a few microns is employed, a three percent concentration of semiconductor powder in the enamel is preferred.

Figure 4:
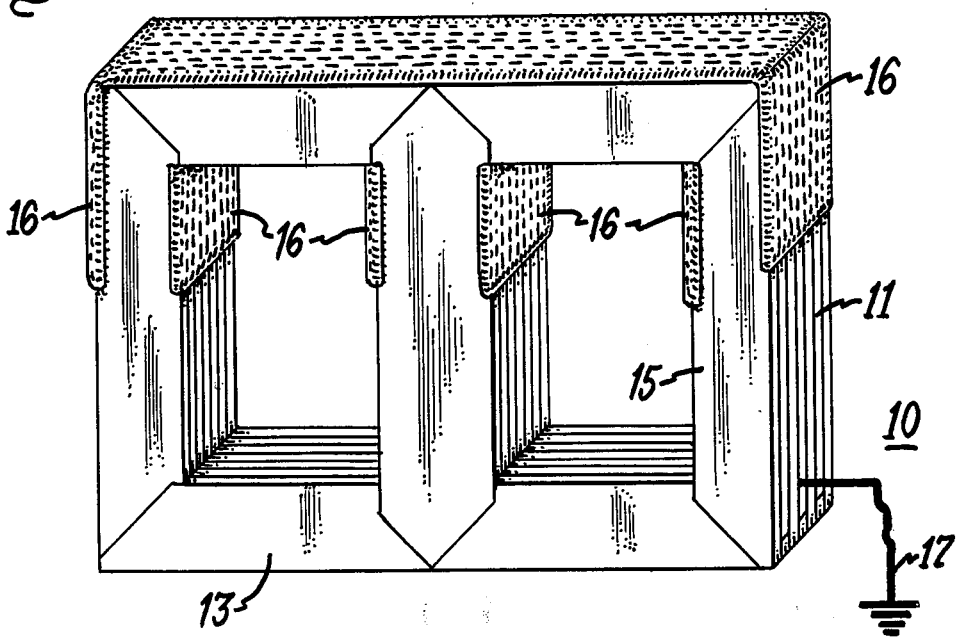
FIG. 4 is a front perspective view of the core of FIG. 1 containing the semiconductor coating of the instant invention applied to the outer surface of the core laminations.

A transformer core 10, shown in FIG. 4, is similar to the one shown in FIG. 1 and contains a plurality of laminations 11 arranged as vertically extending legs 12 and horizontally extending yokes 13. The laminations 11 contain a first coating of inorganic insulating material 15, and can also contain a second coating of insulating enamel as described earlier. A coating of insulating enamel 16 containing a plurality of semiconductive particles is coated on at least a part of each transformer core section to provide electrical semiconductor contact between each of the individual laminations 11. A ground lead 17 is interposed between two adjacent laminations 11. During impulse conditions, the impulse voltage is sufficient to cause the semiconductor particles to become electrically conductive and to allow charge current to transfer through other laminations 11. Potential differences of up to approximately 100 volts can be generated across a pair of laminations for durations of up to 40 microseconds after the period of impulse has ceased. In order to efficiently avoid excessive potential differences between laminations during impulse, the semiconductor material should be capable of bleeding off voltages between adjacent laminations in the order of three to four volts. Zinc oxide and silicon carbide materials are preferred as a semiconductor material to provide the proper degree of conduction between the laminations at the required voltage values. Both of these materials are compatible with the transformer insulating oil dielectric requirements and are relatively good resistors at normal transformer operating voltages.

Figure 5:
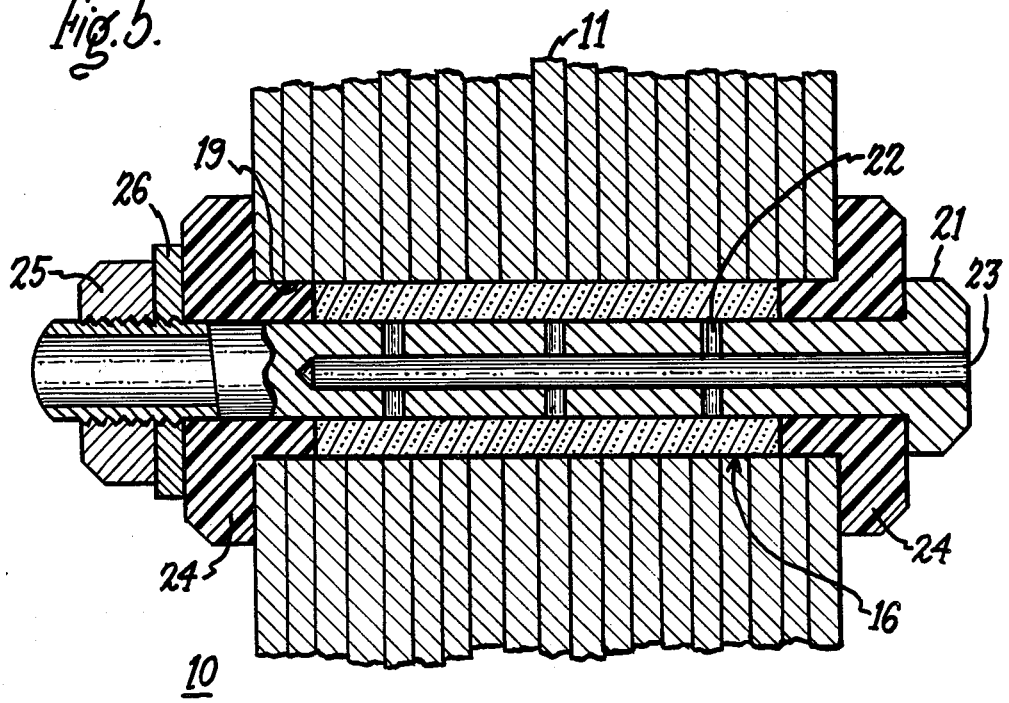
FIG. 5 is a cross-sectional view showing the semiconducting material in captive form within the core.

Besides coating the individual laminations during the enamel coating process as described for the embodiment depicted in FIG. 3, or coating the laminations after the core has been assembled as shown in FIG. 4, another method for providing the charge leakage properties of the invention is shown in FIG. 5. A transformer core 10 of the type consisting of a plurality of laminations 11 is provided with a hole 19.

Bolt 21 passing through hole 19 contains a plurality of passages 22 interconnecting with a passageway 23 extending partially through bolt 21. Bolt 21 is insulated from laminations 11 by means of a pair of insulating bushings 24. Nut 25 and washer 26 are used for securing bolt 21 to laminations 11. A quantity of organic insulating material 16 containing semiconductor powder is forced into passageway 23 and out through passages 22 into good contact with laminations 11 as well as bolt 21. A ground connection can then be made with bolt 21 to insure good electrical contact between organic insulating material 16, containing semiconductor powder, and ground.

Figure 2:
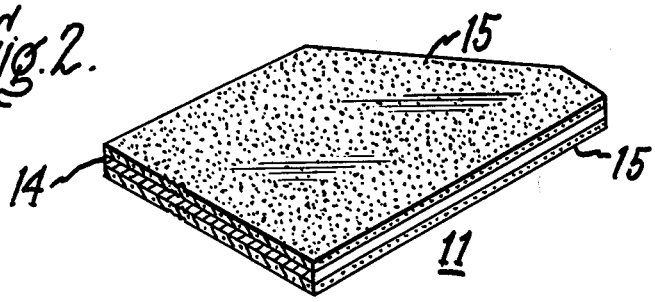
FIG. 2 is a top perspective view of one of the laminations used within the core of FIG. 1.

In some applications the semiconductor powder can be added directly to the inorganic insulating material 15 that is applied directly to the core steel 14 of FIG. 2 immediately after the steel drawing process described earlier. In this manner the semiconducting material directly contacts the core steel 14 to provide the necessary charge transfer facility during impulse without the need for an insulating enamel coating 16.

Although the semiconductor enamel coating of the invention is disclosed herein for application to transformer cores, this is by way of example only. The semiconductor enamel system of the invention can be used in any type inductive apparatus employing a laminated metal core.

We claim:

1. A transformer core comprising: at least two legs; upper and lower yokes joining said legs in a closed magnetic circuit, said legs and yokes each including a plurality of steel laminations arranged in a stack, electrically insulated from each other, and having a passageway therethrough;
an electrical ground lead connected with at least one of said core laminations;
semiconductor material disposed within said passageway and cooperating with said ground lead and said laminations to provide a current leakage path to ground for excessive electrical charges created on said core laminations as a result of a transformer impulse voltage condition.

2. The core of claim 1 further including means for holding said laminations together and for providing good contact between said laminations and said semiconductor material.

3. The core of claim 1 wherein said semiconductor material comprises a quantity of semiconductor powder mixed with an adhesive.

4. The core of claim 3 wherein said semiconductor powder is selected from the group consisting of zinc oxide and silicon carbide.

5. The core of claim 1 wherein said semiconductor powder comprises at least from one to ten per cent by weight.

* * * * *